US005235896A

United States Patent [19]

Huber

[11] Patent Number: 5,235,896

[45] Date of Patent: Aug. 17, 1993

[54] HYDRAULIC CYLINDER/PISTON MECHANISM

[75] Inventor: Gerhard Huber, Frankenhofen, Fed. Rep. of Germany

[73] Assignee: Hoerbiger Fluidtechnik GmbH, Scongau, Fed. Rep. of Germany

[21] Appl. No.: 853,245

[22] Filed: Mar. 18, 1992

[30] Foreign Application Priority Data

Mar. 20, 1991 [AT] Austria ..... 619/91

[51] Int. Cl.[5] ..... F15B 15/26

[52] U.S. Cl. ..... 91/44; 91/45; 91/420; 91/433; 91/464

[58] Field of Search ..... 91/44, 45, 420, 433, 91/464; 92/28

[56] References Cited

U.S. PATENT DOCUMENTS

| | | | |
|---|---|---|---|
| 3,274,902 | 9/1966 | Kleckner | 91/420 |
| 3,747,351 | 7/1973 | Wilkerson | 91/420 |
| 3,908,515 | 9/1975 | Johnson | 91/420 |
| 3,933,167 | 1/1976 | Byers, Jr. | 91/420 |
| 4,244,275 | 1/1981 | Smilges | 91/420 |
| 5,081,904 | 1/1992 | Horn et al. | 91/420 |

FOREIGN PATENT DOCUMENTS

| | | | |
|---|---|---|---|
| 0006045 | 12/1979 | European Pat. Off. | 91/420 |
| 0051728 | 5/1982 | European Pat. Off. | 91/420 |
| 2946765 | 5/1981 | Fed. Rep. of Germany | 91/420 |
| 0065403 | 4/1982 | Japan | 91/420 |
| 0107405 | 7/1982 | Japan | 91/420 |
| 8301819 | 5/1983 | PCT Int'l Appl. | 91/420 |
| 267283 | 7/1970 | U.S.S.R. | 91/420 |
| 0724805 | 3/1980 | U.S.S.R. | 91/420 |
| 0879065 | 11/1981 | U.S.S.R. | 91/420 |
| 0885644 | 11/1981 | U.S.S.R. | 91/420 |
| 2073564 | 10/1981 | United Kingdom | 91/420 |

*Primary Examiner*—Thomas E. Denion

*Attorney, Agent, or Firm*—Watson, Cole, Grindle & Watson

[57] ABSTRACT

In a position independent locking of a hydraulic cylinder/piston mechanism, a pressure limiting member is provided in the supply pipe for the hydraulic medium, with the pressure limiting member being open during the hydraulic displacement of the piston and is closed during lack of hydraulic pressure. The pressure limiting member opens starting from a specific pressurization of the hydraulic medium as a result of a force generated by means of the piston and is located in a related working chamber.

9 Claims, 1 Drawing Sheet

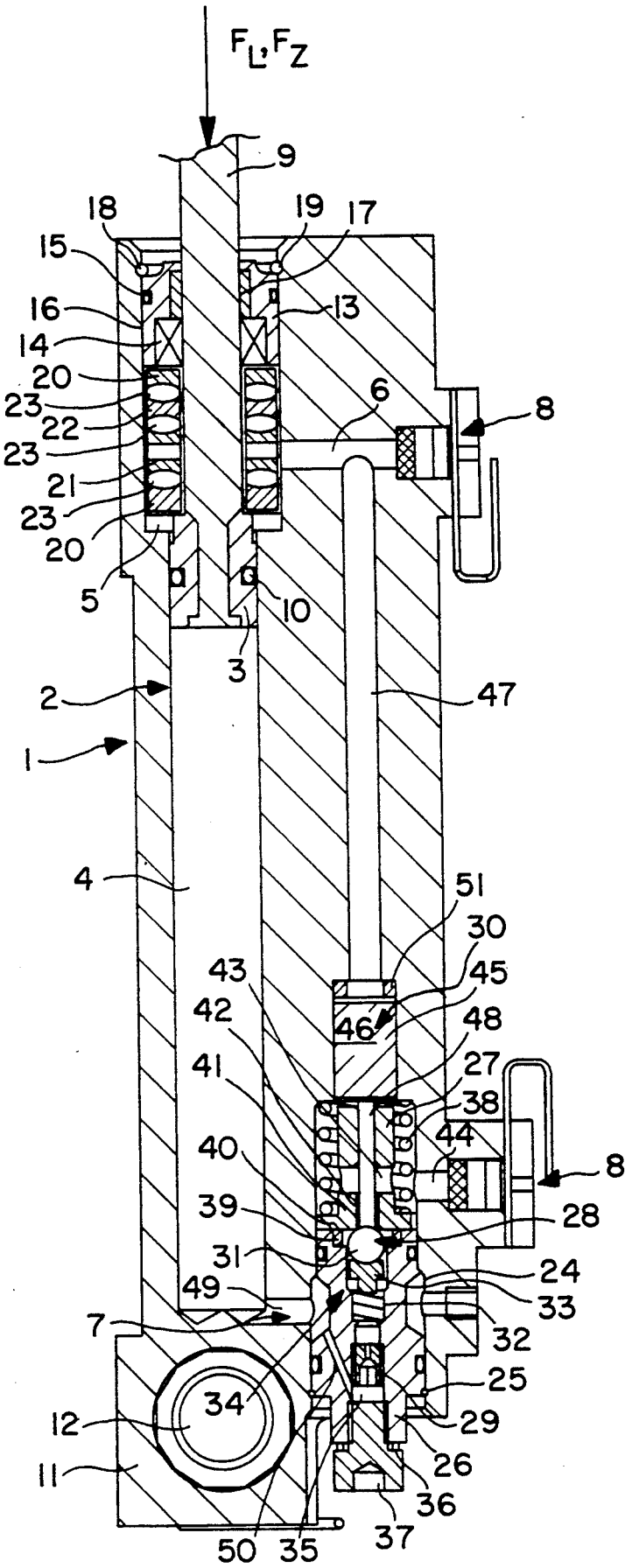
$F_L, F_Z$
9
18
19
17
15
16
13
14
20
23
22
23
21
23
20
6
8
5
10
3
2
47
1
4
51
30
43
45
42
46
48
41
27
38
44
40
8
39
28
31
24
49
33
7
32
34
25
12
29
26
11
36
37
50
35

HYDRAULIC CYLINDER/PISTON MECHANISM

BACKGROUND OF THE INVENTION

1. Field of the Invention

The invention relates to a hydraulic cylinder/piston arrangement, with one cylinder, which exhibits at least on one side of a piston, which can be adjusted therein, a working chamber connected outwardly by means of a supply pipe for the hydraulic medium and also exhibits a locking device to secure the piston when the hydraulic medium pressure fails.

Hydraulically operated working cylinders are used currently in a variety of connections to move or displace device and machine parts or the like. The most important advantages of these components are their simplicity and reliability and the circumstance that any increase or decrease in the speed and lift force can be obtained over a wide range.

2. Related Art

Arrangements of the aforementioned kind are known, for example, from the AT-PS 302,107, DE-OS 27 27 506, DE-OS 31 43 040, and also the DE-OS 37 32 561 and are used usually due to safety reasons where the piston or the subassemblies moved by said piston are to be secured or locked during a sudden failure of the pressure of the working medium in order to avoid uncontrolled movements. To this end, for the known arrangements of the aforementioned kind locking elements act mechanically on the piston or a piston rod connected thereto, where these locking elements are also operated by means of the or a pressure medium; apart for this, however, an electrical actuation would also be conceivable and possible.

All of the known arrangements of the aforementioned kind have the drawback of a relatively complicated design of the cylinder/piston arrangement, since separate devices or specific designs of the cylinders, pistons, piston rods etc. must always be provided; in addition, to operate the locking elements specific connections, controllers and the like must be provided, a feature that increases in total the complexity of the arrangements, on the one hand, and their susceptibility to trouble, on the other hand.

Another drawback of the known arrangements is that once the locking device has become effective the piston or the subassembly actuated therewith cannot be moved any further—or at least not simply, so that, for example, a transitory manual operation is rendered difficult or impossible. This is especially unpleasant, when, for example, with a hydraulic failure a car door or a convertible top operated with such an arrangement can no longer be completely opened or closed without performing complicated repair work.

SUMMARY OF THE INVENTION

The object of the present invention is to improve an arrangement of the aforementioned kind in such a manner that the aforementioned drawbacks of such known arrangements are avoided and that in particular a simple construction of the locking device is enabled that allows at least a transitory manual operation of the subassembly that is otherwise displaced by the piston, without any special repair work.

This object is achieved according to the present invention with a device of the aforementioned kind in that the locking device exhibits a pressure limiting member in at least the one supply pipe, which is open during the hydraulic displacement of the piston and is closed during pressureless connections and opens starting from a specific pressurization of the hydraulic medium, situated in the related working chamber, as a consequence of a force generated by means of the piston. When and as long as the piston is displaced hydraulically as specified, the function of the cylinder/piston arrangement according to the invention is in essence unchanged with respect to the known cylinder/piston arrangement. When the piston stands still or the connections are without pressure, no hydraulic medium is conveyed any more over the supply pipe to or from the working chamber; and the pressure limiting member is closed. Insofar as in this state—irrespective to the position in which the piston is situated at the time in the cylinder—the pressure of the hydraulic medium fails (for example as a consequence of a failure in the power supply of a pump, as a consequence of a leak in the pipe to the pump, or the like), the working chamber in the cylinder with the hydraulic medium located therein remains closed, thus securing hydraulically the piston and the subassembly actuated by said piston. If it is desired to continue moving the piston or the subassembly connected to said piston, for example, by hand, this can be done without any other additional measures after overcoming a specific pressurization of the hydraulic medium located in the working chamber: thus after recently exceeding this pressurization the piston in turn is locked until force corresponding to this pressurization is raised.

Thus, the invention is a locking device, which acts purely hydraulically on the piston and from the point of view of the basic function can also be realized by means of a closed position provided on the control valves of such cylinder/piston arrangements. The important difference lies in the fact that, when the pressure of the working medium fails suddenly, a control valve is only by chance in the closed position and in the two other positions the entire system immediately loses pressure, said loss in pressure rendering a controlled securing of the piston in position impossible, whereas in the arrangement according to the invention when the inlet pressure fails and the piston simultaneously comes to a standstill, the pressure limiting member also closes and thus the piston is secured.

According to an especially preferred design of the invention an opening device is provided that holds open or circumvents the pressure limiting member when the piston is hydraulically actuated. Thus, it can be ensured that the working pressure required for the normal operation of the cylinder/piston arrangement does not have to be increased in order to actuate the pressure limiting member for it to open.

With respect to the last point an embodiment of the invention is especially advantageous, according to which the opening device exhibits a cylinder/piston displacement arrangement, which is connected hydraulically to the opposite working chamber in the cylinder and whose piston when pressurized holds open a spring-loaded valve element in the supply line of the working chamber assigned to the pressure limiting member. By suitable cross section dimensioning of this displacement arrangement an opening of the pressure limiting member when the entire system is under normal working pressure can be ensured in a simple manner. Thus, the hydraulic medium pressure, acting into the opposite working chamber in order to displace the working piston in the direction of a reduction of the working chamber assigned to the pressure limiting member, serves also simultaneously to hold open the valve element, which enables a largely unobstructed discharge of the hydraulic medium from the diminishing working chamber while circumventing the pressure limiting member, so that the normal hydraulic actuation of the working piston is not significantly obstructed and no separate pressure connections or the like are necessary for this actuation of the valve element.

In another embodiment of the invention the pressure limiting member can exhibit a closing element sealing in a spring-loaded manner the supply pipe to a stationary sealing surface. By selecting or also setting the spring loading of this closing element the pressurization, starting from which the pressure limiting member opens in order to overcome the securing in position of the working piston, can be specified or varied in the interaction with the size of the attack surface for the pressure to be limited.

According to another advantageous embodiment of the invention the closing element can exhibit a central connecting bore for the supply pipe, which interacts with the valve element and receives with clearance an actuating cone connected to the piston of the cylinder/-piston displacement arrangement. Thus the closing element of the pressure limiting member and the valve element act together substantially concentrically in order to facilitate the normal displacement of the working piston, a feature that enables a simple and compact construction of the arrangement. The hydraulic medium can flow in and out via the clearance between the actuating cone and the central connecting bore, when the valve element is open.

In some cases another embodiment of the invention, according to which a restrictor is provided in the supply pipe, is advantageous. Said restrictor acts as a so-called discharge choke, which prevents a jerky insertion of the working piston, in that a small back pressure remains in the piston chamber.

According to another especially preferred embodiment of the design of the invention it is provided that the pressure limiting member, the opening device, valve element, and restrictor are disposed in a borehole of the housing of the cylinder, which is closed outwardly and connects the hydraulic connection of the cylinder to the working chamber. Thus, the result is a very compact construction of the arrangement of the invention on which only the usual connections for the hydraulic medium to or from a controller are provided. Furthermore, the risk of damaging the lines between the pressure limiting member and the related working chamber is virtually totally ruled out.

BRIEF DESCRIPTION OF THE DRAWING

The invention is explained in detail in the following with the aid of the drawing, which is a partial longitudinal sectional view of the cylinder/piston arrangement according to the invention.

DETAILED DESCRIPTION OF THE PREFERRED EMBODIMENT

The illustrated hydraulic cylinder/piston arrangement comprises in essence a housing 1, which receives a cylinder 2, whose two sides of a piston 3 that can be adjusted in this cylinder 2 exhibit working chambers 4, 5, which are connected outwardly via supply pipes 6, 7 for the hydraulic medium to hydraulic connections B. The piston 3 sealed in the cylinder 2 by means of a seal 10 communicates with a piston rod 9, which projects from said housing on the illustrated upper end of the housing 1 and serves to actuate the parts of the device or machine that are not shown in greater detail. The illustrated bottom end of the housing 1 has a receiving part 11 with an attachment bore 12, by means of which the entire arrangement can be attached, for example, stationarily or also rotatably to a machine bed or the like.

As the upper boundary of the upper working chamber 5 in the drawing an insert 13 is provided that secures, on the one hand, a sealing with respect to the piston rod 9 by means of seals 14, 15 and, on the other hand, the receiving bore 16 in housing 1 and centers the piston rod 9 on a guide sleeve 17. This insert 13 is held in a receiving bore 16 by means of a retaining ring 18 disposed in a groove 19. Between the insert 13 and the illustrated bottom end of the receiving bore 16 or the working chamber 5 there is a mechanical final position damping for the illustrated upper adjustment of the piston 3, which comprises disks 20, 21 and 22 with intermediary damping elements 23.

A pressure limiting member 27, a valve element 28, a restrictor 29 and an opening device 30 for the valve element 28 are disposed in a stepped bore 24 of housing 1 which lies here axis-parallel to the cylinder 2 and which is closed outwardly by means of a cover 26 held with a retaining ring 25 and connects the illustrated bottom hydraulic connection 8 of cylinder 2 to the working chamber 4. The closing ball 31 of the valve element 28 and a load body 33 pushed upwardly in the drawing by means of a spring 32 are inserted into a stepped bore 34 of the cover 26 starting from the illustrated upper side. Starting from the bottom side, the restrictor 29 is inserted into another bore 35, which is also stepped and which in turn is closed with a locking screw 37 sealed by means of a seal 36.

The pressure limiting member 27 has a closing element 41, which seals by means of a spring 38 against a sealing surface designed on a sealing ring 39 on the illustrated upper end of the bore 34 in the cover 26 and which has a central connecting bore 42 for the supply pipe 7 extending from the working chamber 4 to the hydraulic connection B. The illustrated bottom end of this connecting bore 42 acts with the closing ball 31 of the valve element 28 and thus is closed in the pressureless state of the arrangement. Furthermore, the closing element 41 is provided on the side vertically to the connecting bore 42 with a bore 43, which aligns substantially with the bore 44, leading to the hydraulic connection 8, in housing 1.

The opening device 30, which exhibits a cylinder/piston displacement arrangement 45 that is connected hydraulically to the opposing working chamber 5 and whose piston 46 when pressurized holds open the valve element 28 by means of the connecting line 47 or its closing ball 31 by means of an actuating cone 48, is disposed in the drawing above the pressure limiting member 27.

The illustrated arrangement allows the piston rod 9 or the piston 3 to be secured in any arbitrary position against a defined counter force $F_L$. This occurs in the following manner. The counter force $F_L$ acts in the direction of a depressing force. A pressure, which corresponds to the load $F_L$, is generated in the piston-sided working chamber 5, the hydraulic medium being locked in this working chamber 5. The closing ball 31 of the valve element 28 seals on the illustrated bottom end of the connecting bore 42; and the closing element 41 of the pressure limiting member 27 is pushed by means of the prestress of the spring 38 onto the sealing ring 39 and also seals there.

If at this stage the force $F_L$ exceeds the value, defined by the spring 3B or the sealing ring 39, as a consequence of an additional force $F_2$, the closing element 41 opens on the sealing surface 40 and allows the hydraulic medium to flow from the working chamber 4 to the related hydraulic connection 8. In so doing, the hydraulic medium takes the path through the lateral bore 49 on the illustrated bottom end of the working chamber, the connecting bores 50 in the cover 26, the restrictor 29, the outer diameter of the load body 33, the outer diameter of the closing ball 31, the opened sealing surface 40, the region of the bore 24, which receives the spring 38, and the bore 44 of the hydraulic connection 8.

If at this stage the cylinder/piston arrangement is to be driven in hydraulically, suitable pressure is applied to the illustrated upper hydraulic connection 8. This pressure in turn acts, on the one hand, in the working chamber 5 from the top on the piston 3 and, on the other hand, by means of the connecting line 47 on the piston 46 of the cylinder/piston displacement arrangement 45 or the opening device 30. Thus, the piston 46 moves in the drawing towards the bottom and in so doing pushes the closing ball 31 from its seat on the bottom end of the connecting bore 42 towards the bottom. The ratio of the diameter between piston 46 and the sealing point of the closing ball 31 is so large that merely a small pressure suffices to lift off the closing ball 31 against a pressure (load pressure) prevailing in the working chamber 4. When the closing ball 31 is open, the hydraulic medium in the working chamber 4 can flow to the hydraulic connection 8 with only a small drop in pressure by means of the clearance between actuating cone 48 and connecting bore 42 and through the bore 43.

The restrictor 29 is provided as the socalled discharge choke, which prevents a jerky insertion of the piston 3, in that a small counter pressure remains in the working chamber 4. The annular disk 51 has on the illustrated upper side of the piston 46 only the function of a spacer. The locking screw 37 allows a simple interchange of the restrictor 29, so that the suitable nozzle diameter can be selected for the respective load. With an optimized nozzle diameter, the locking screw 37 could, of course, be dispensed with and the cover 26 would not have to be drilled at this point. Moreover, the throttling effect could also be fulfilled by a suitable shaping of the bores 50, which could then also open directly into the installation space for the spring 32.

The piston 3 can be moved out differentially or simply. In so doing, the hydraulic medium flows from the bottom hydraulic connection B through the bore 43 and the clearance between connecting bore 42 and actuating cone 4B, opens the closing ball 31 against the only slightly prestressed spring 32 and flows further through the restrictor 29, the bores 50 and the bore 49 into the working chamber 4, resulting in the piston 3 and piston rod 9 moving out. During differential traverse to the end position, the pressure in the working chamber 5 facilitates the opening of the closing ball 31 in the manner already described above.

The aforementioned mechanical damping in the upper region of the illustrated arrangement is effective, because shortly before the start of damping the disks 20, 21, 22 exhibit a specific spacing and the damping rings 23 are round. If at this stage while traversing to the end position the piston 3 approaches the disks, the end stop is decelerated owing to the deformation of the damping elements 23.

The illustrated and described arrangement facilitates thus a locking of the piston 3 or the piston rod 9 in any position without the necessity of mechanical wearing parts. For normal insertion, no excess pressure is necessary; thus a jerky insertion can be readily avoided by means of the restrictor 29. Such arrangements are especially suitable, for example, for opening and closing the tops of convertibles. When the pressure fails, the piston rod 9 remains standing in the momentary position against the weight of the top (counter force $F_L$, load). If at this stage the top is to be closed by hand, a small additional force $F_2$ suffices to close or push in the piston rod 9.

What is claimed is:

1. Hydraulic cylinder/piston mechanism, comprising:
- a cylinder;
- a piston displaceable within said cylinder;
- at least one working chamber located on one side of said piston and receiving hydraulic medium through a supply pipe
- and means for locking the piston upon failure of the hydraulic medium;
- said locking means including a pressure limiting member which
  - a) is open during the hydraulic displacement of the piston and
  - b) is closed during pressureless hydraulic conditions and starts opening from a specific pressurization of the hydraulic medium resulting from a force generated via said piston.

2. The mechanism as claimed in claim 1, further comprising an opening device for holding open or bypassing said pressure limiting member during hydraulic actuation of said piston.

3. The mechanism as claimed in claim 2, wherein said opening device includes a second cylinder/piston mechanism connected hydraulically to said working chamber in said cylinder, and said pressure limiting member further including a spring-loaded valve member located in the hydraulic medium supply pipe to said working chamber and which is held open by said second piston with hydraulic pressurization thereof.

4. The mechanism as claimed in claim 1, wherein said pressure limiting member includes a closing member for sealing said supply pipe.

5. The mechanism as claimed in claim 2, wherein said pressure limiting member includes a closing member for sealing said supply pipe.

6. The mechanism as claimed in claim 3, wherein said pressure limiting member includes a closing member for sealing said supply pipe.

7. The mechanism as claimed in claim 6, wherein said closing member has a central connecting bore interacting with said spring-loaded valve member and an actuating gudgeon received in said connecting bore and connected to said second piston.

8. The mechanism as claimed in claim 1, further comprising a restrictor in said supply pipe.

9. The mechanism as claimed in claim 7, further comprising a restrictor in said supply pipe and a borehole within the housing associated with said cylinder and containing said pressure limiting member, an opening device, a valve member and said restrictor, said borehole being closed outwardly and connecting the hydraulic medimum to said working chamber.

* * * * *